US007326034B2

(12) United States Patent
Sheth et al.

(10) Patent No.: US 7,326,034 B2
(45) Date of Patent: Feb. 5, 2008

(54) PUMP APPARATUS AND METHODS OF MAKING AND USING SAME

(75) Inventors: Ketankumar K. Sheth, Tulsa, OK (US); Janet Savarimuthu, Bartlesville, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 225 days.

(21) Appl. No.: 11/162,549

(22) Filed: Sep. 14, 2005

(65) Prior Publication Data

US 2007/0059166 A1 Mar. 15, 2007

(51) Int. Cl.
*F04D 13/14* (2006.01)

(52) U.S. Cl. ..... 415/199.2; 415/901; 416/175

(58) Field of Classification Search ..... 416/175; 415/901

See application file for complete search history.

(56) References Cited

U.S. PATENT DOCUMENTS

| | | | | |
|---|---|---|---|---|
| 2,220,334 | A | 11/1940 | Holmberg | |
| 4,726,734 | A * | 2/1988 | Zientek et al. | 415/143 |
| 4,838,758 | A | 6/1989 | Sheth | |
| 4,861,239 | A | 8/1989 | Simmons | |
| 5,207,810 | A | 5/1993 | Sheth | |
| 5,209,650 | A | 5/1993 | Lemieux | |
| 5,547,350 | A | 8/1996 | Rawal | |
| 5,553,998 | A * | 9/1996 | Muhlhoff et al. | 415/143 |
| 5,605,193 | A | 2/1997 | Bearden | |
| 5,713,727 | A | 2/1998 | Veronesi | |
| 5,755,288 | A | 5/1998 | Bearden | |
| 5,961,282 | A * | 10/1999 | Wittrisch et al. | 415/199.2 |
| 6,068,444 | A | 5/2000 | Sheth | |
| 6,106,224 | A | 8/2000 | Sheth | |
| 6,138,754 | A | 10/2000 | Veneruso | |
| 6,206,093 | B1 | 3/2001 | Lee | |
| 6,425,735 | B1 | 7/2002 | Sheth | |
| 6,666,664 | B2 | 12/2003 | Gross | |
| 6,688,860 | B2 | 2/2004 | Du | |
| 6,695,052 | B2 | 2/2004 | Branstetter | |
| 6,811,382 | B2 | 11/2004 | Buchanan | |
| 6,863,124 | B2 | 3/2005 | Araux | |

* cited by examiner

*Primary Examiner*—Richard A. Edgar
(74) *Attorney, Agent, or Firm*—Jeffrey L. Wendt; Kevin Brayton McGoff; Bryan P. Galloway

(57) ABSTRACT

Pump apparatus and methods of making and using same are disclosed. One inventive apparatus includes at least two pump stages having different performance characteristics combined in series to substantially match an intended pumping application. An inventive method includes selecting two or more pump stages having different performance characteristics that when combined in series overcome limitations of at least one of the pump stages.

21 Claims, 6 Drawing Sheets

PUMP APPARATUS AND METHODS OF MAKING AND USING SAME

BACKGROUND OF THE INVENTION

The present invention relates generally to the field of fluid transfer, and more specifically to submersible and surface pump apparatus and methods of making and using same.

Electrical submersible pumps (ESPs) are used for artificial lifting of fluid from a well or reservoir. An ESP typically comprises: (1) an electrical submersible motor—which is the driver—each motor may be up to about 30 feet in length, with multiple sections of motors available based on the power requirement; (2) a seal section (sometimes referred to in the art as a protector)—which functions to equalize the pressure between the inside of the system and the outside of the system and also acts as a reservoir for compensating the internal oil expansion from the motor; and (3) a submersible pump—the driven portion—having one or more pump stages inside a housing. One pump may be 24 feet or more in length, and multiple identical pump stages may be installed based on the pressure that has to be developed. The order in which the sections are typically installed in the well is motor, seal section and pump, but alternative arrangements may be used. Each pump stage is capable of producing certain pressure (head) which is cumulative—for example, if a stage can produce 20 feet of head, 100 stages will produce 100×20=2000 feet of head.

In a variety of applications, it is advantageous to utilize a surface pump, such as a horizontal pumping system ("HPS"), which generally includes a driver, which may be a motor, turbine, diesel or non-diesel internal combustion engine, generator, and the like, in some cases combined with a protector, seal chamber, and the like, and a pump mounted on a horizontal skid. For example, an HPS may be used in applications such as water floods, liquid propane injection, water supply, booster service, salt water disposal and crude oil transfer.

Whether used in surface applications or downhole, each pump stage has definite performance characteristics limited by and/or based on the slope of head versus flow rate curve, amount of head (lift) produced, efficiency, brake horsepower, and down thrust. For gas handling in downhole applications, a taper pump unit approach has been used. A taper pump unit consists of two or more pump housings, each pump housing having different pump stages in it. Taper pumps can not overcome the limitations of a single pump stage.

From the above it is evident that there is a need in the art for improvement in surface pumps and downhole pumps, such as electrical submersible pumps.

SUMMARY OF THE INVENTION

In accordance with the present invention, pump apparatus and methods of making and using same are described that reduce or overcome problems in previously known apparatus and methods. By combining two or more pump stages having different performance characteristics, one or more limitations of performance characteristics of one of the pump stages can be overcome by the performance characteristics of other pump stage. Two or more pumps stages, having different performance characteristics, may be combined as a single unit to match the application requirements by changing head flow characteristics, brake horsepower characteristics, operating range and thrust characteristics. The change in performance characteristics is based on the stage mixing percentage or ratio, as defined herein. The inventive pumps may, for example, provide a solution for the 3000 to 4000 BPD flow range of pumps in downhole applications in 5.5 inch diameter casing. This is a specific example and this idea can be easily used for different size pump stages in any application.

A first aspect of the invention are apparatus comprising:

(a) a driver, which may be a motor, turbine, diesel or non-diesel internal combustion engine, generator, and the like, in some cases combined with a protector, seal chamber, thrust chamber, gear box and the like;

(b) a driver shaft turned by the driver; and (c) at least two pump stages on a pump shaft arranged in series and having different performance characteristics, the at least two pump stages adapted to work together to substantially match an intended pumping application.

The driver shaft may be one and the same as the pump shaft in certain embodiments, and in certain other embodiments the pump shaft may be mechanically coupled to and driven by the driver shaft. In other embodiments, the driver shaft and the pump shaft may be distinct and not be coupled mechanically, such as in magnetic couplings wherein the driver shaft drives a magnetic coupling comprising magnets on the driver shaft which interact with magnets in a protector, in which case the protector shaft mechanically connects to and drives the pump shaft.

Apparatus of the invention include those apparatus wherein the at least two pump stages comprise a first set of pump stages each having a first defined set of performance characteristics, and a second set of pump stages each having a second defined set of performance characteristics. Apparatus of the invention include those wherein the performance characteristics are selected from head flow characteristics, brake horsepower characteristics, operating range, thrust characteristics, efficiency, net positive suction head (NPSH), and two or more thereof.

The inventive apparatus may further include a stage mixing ratio ranging from about 1:99 to about 99:1. The stage mixing ratio may in some embodiments range from about 1:9 to about 9:1. In certain other embodiments the stage mixing ratio may range from about 3:7 to about 7:3, and in other embodiments the stage mixing ratio may be 1:1.

Certain embodiments of the apparatus of the invention, such as those suitable for use downhole, may include a motor protector, which may or may not be integral with the motor, and may include integral instrumentation adapted to measure one or more downhole parameters. Apparatus of the invention may be adapted to produce a dynamic head up to 7,500 feet. Surface communication to apparatus of the invention may be through use one or more communication links, including but not limited to hard wire, optical fiber, radio, or microwave transmission. The inventive apparatus and methods may include a chemical detector at or near the motor of the apparatus, which enables an operator to stop the motor, or allows an automated relay to stop the motor, long before hydrocarbons or other chemicals can reach the motor and pose a safety and/or loss of production risk. The chemical detector, if used, may be selected from any functioning system, or future functioning system, or combination of systems.

Another aspect of the invention are methods of making a pump, one method of the invention comprising:

(a) selecting a first pump stage comprising a first set of pump stages, the first set of pump stages having a first pump characteristic;

(b) selecting a second pump stage comprising a second set of pump stages, the second set of pump stages having a second pump characteristic; and (c) attaching the first and second sets of pumps in series on a common pump shaft.

Methods of the invention include those wherein the performance characteristics are selected from head flow characteristics, brake horsepower characteristics, operating range, thrust characteristics, efficiency, NPSH, and two or more thereof.

Yet another aspect of the invention are methods of pumping fluids, one method comprising:

(a) determining a pumping requirement for transferring a fluid;

(b) selecting at least two pump stages to operate in series to form a pump, the at least two pump stages of the pump having different performance characteristics; and (c) pumping the fluid using the pump to meet the pumping requirement.

Apparatus and methods of the invention will become more apparent upon review of the brief description of the drawings, the detailed description of the invention, and the claims that follow.

BRIEF DESCRIPTION OF THE DRAWINGS

The manner in which the objectives of the invention and other desirable characteristics can be obtained is explained in the following description and attached drawings in which.

Figure 1:
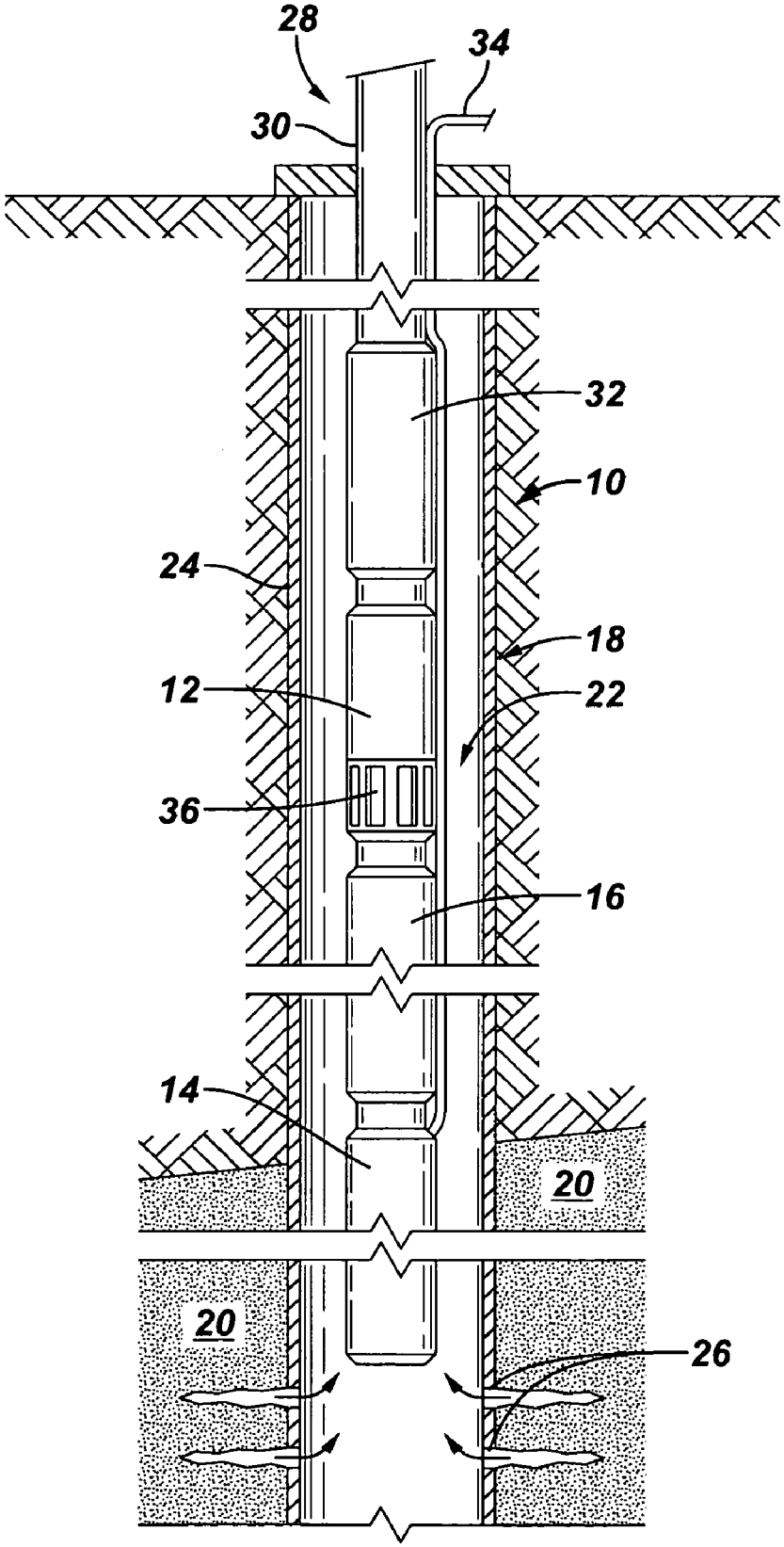
FIG. 1 is a front elevation view of an exemplary electrical submersible pump disposed within a wellbore.

It is to be noted, however, that the appended drawings are not to scale and illustrate only typical embodiments of this invention, and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

All phrases, derivations, collocations and multiword expressions used herein, in particular in the claims that follow, are expressly not limited to nouns and verbs. It is apparent that meanings are not just expressed by nouns and verbs or single words. Languages use a variety of ways to express content. The existence of inventive concepts and the ways in which these are expressed varies in language-cultures. For example, many lexicalized compounds in Germanic languages are often expressed as adjective-noun combinations, noun-preposition-noun combinations or derivations in Romantic languages. The possibility to include phrases, derivations and collocations in the claims is essential for high-quality patents, making it possible to reduce expressions to their conceptual content, and all possible conceptual combinations of words that are compatible with such content (either within a language or across languages) are intended to be included in the used phrases.

The invention describes pump apparatus and methods of making and using same for pumping fluids, for example, to and from wellbores, although the invention is applicable to pumps designed for any intended use, including, but not limited to, so-called surface fluid transfer operations. A "wellbore" may be any type of well, including, but not limited to, a producing well, a non-producing well, an experimental well, and exploratory well, and the like. Wellbores may be vertical, horizontal, some angle between vertical and horizontal, and combinations thereof, for example a vertical well with a non-vertical component. As discussed, pump stages have definite performance characteristics based on the slope of the head versus flow rate curve (typically known as the pump curve), amount of head (lift), net positive suction head (NPSH), efficiency, brake horsepower and down thrust. Operating range of the pump stage is limited by the slope of the head flow curve, thrust, efficiency and head. In inventive apparatus, two or more pump stages, having different performance characteristics, are combined to overcome limitations of one of the pump stages.

Given that there is considerable investment in existing equipment, it would be an advance in the art if existing pump stages could be combined using existing apparatus to increase operating range and efficiency during pumping, with minimal interruption of well operations. This invention offers methods and apparatus for these purposes.

FIGS. 1-9 focus on submersible pumps only as examples of the inventive apparatus and methods, but the invention is not so limited. Referring generally to FIG. 1, a prior art pumping system 10, such as a submersible pumping system, is illustrated. Pumping system 10 may comprise a variety of components depending on the particular application or environment in which it is used. Typically, system 10 has at least a submersible pump 12, a motor 14 and a protector 16. Motor 14 may comprise any electric motor or other motor that requires volume compensation based on, for instance, the thermal expansion and/or contraction of internal fluid. The submersible pump 12 may be of a variety of types, for example a centrifugal pump, an axial flow pump, or a mixture thereof, although the principles of the invention are pertinent only to the centrifugal pump portion of the pump. System 10 may also comprise a gearbox, thrust chamber, seal chamber, and the like, as is known in the art.

In the illustrated example, pumping system 10 is designed for deployment in a well 18 within a geological formation 20 containing desirable production fluids, such as petroleum. In a typical application, a wellbore 22 is drilled and lined with a wellbore casing 24. Wellbore casing 24 typically has a plurality of openings 26, for example perforations, through which production fluids may flow into wellbore 22.

Pumping system 10 is deployed in wellbore 22 by a deployment system 28 that may have a variety of forms and configurations. For example, deployment system 28 may comprise tubing 30 connected to pump 12 by a connector 32. Power is provided to submersible motor 14 via a power cable 34. Motor 14, in turn, powers centrifugal pump 12, which draws production fluid in through a pump intake 36 and pumps the production fluid to the surface via tubing 30.

It should be noted that the illustrated submersible pumping system 10 is merely an exemplary embodiment. Other components can be added to the system, and other deployment systems may be implemented. Additionally, the production fluids may be pumped to the surface through tubing 30 or through the annulus formed between deployment system 28 and wellbore casing 24. In any of these configurations of submersible pumping system 10, it may be desirable to be able to use two or more centrifugal pump stages having different operating characteristics in accordance with the present invention.

In certain embodiments, system 10 may have multiple sections of motor protector 16 disposed about motor 14. A diagrammatical cross-sectional view of an exemplary embodiment of system 10 is provided in FIG. 2. As illustrated, system 10 comprises pump 12, motor 14, and various motor protection components disposed in a housing 38. Pump 12 is rotatably coupled to motor 14 via a shaft 40, which extends lengthwise through the housing 38 (for example, one or more housing sections coupled together). System 10 and shaft 40 may have multiple sections, which can be intercoupled via couplings and flanges. For example, shaft 40 has couplings 42 and 44 and an intermediate shaft section 46 disposed between pump 12 and motor 14.

A variety of seals, filters, absorbent assemblies and other protection elements also may be disposed in housing 38 to protect motor 14. A thrust bearing 48 is disposed about shaft 40 to accommodate and support the thrust load from pump 12. A plurality of shaft seals, such as shaft seals 50 and 52, are also disposed about shaft 40 between pump 12 and motor 14 to isolate a motor fluid 54 in motor 14 from external fluids, such as well fluids and particulates. Shaft seals 50 and 52 also may include stationary and rotational components, which may be disposed about shaft 40 in a variety of configurations. System 10 also may include a plurality of moisture absorbent assemblies, such as moisture absorbent assemblies 56, 58, and 60, disposed throughout housing 38 between pump 12 and motor 14. These moisture absorbent assemblies 56-60 absorb and isolate undesirable fluids (for example, water, $H_2S$, and the like) that have entered or may enter housing 38 through shaft seals 50 and 52 or though other locations. For example, moisture absorbent assemblies 56 and 58 may be disposed about shaft 40 at a location between pump 12 and motor 14, while moisture absorbent assembly 60 may be disposed on an opposite side of motor 14 adjacent a bellows assembly 64. In addition, the actual protector section above the motor may include a hard bearing head with shedder.

Figure 2:
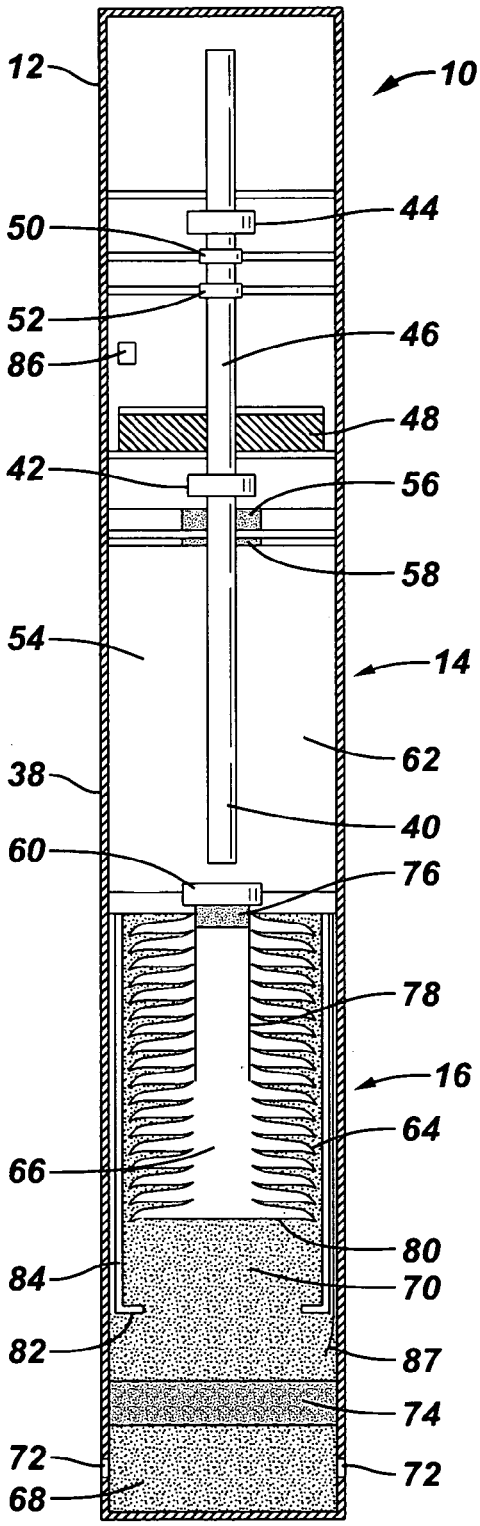
FIG. 2 is a diagrammatical cross-section of the pump of FIG. 1 having a bellows assembly to separate well fluid from motor fluid, which is positively pressurized within the motor housing.

As illustrated in FIG. 2, the motor fluid 54 is in fluid communication with an interior 66 of the bellows assembly 64, while well fluid 68 is in fluid communication with an exterior 70 of the bellows assembly 64. Accordingly, the bellows assembly 64 seals the motor fluid 54 from the well fluid 68, while positively pressurizing the motor fluid 54 relative to the well fluid 68 (e.g., a 50 psi pressure differential). The spring force, or resistance, of the bellows assembly 64 ensures that the motor fluid 54 maintains a higher pressure than that of the well fluid 68. A separate spring assembly or biasing structure also may be incorporated in bellows assembly 64 to add to the spring force, or resistance, which ensures that the motor fluid 54 maintains a higher pressure than that of the well fluid 68.

The bellows assembly 64 may embody a variety of structural features, geometries and materials as known in the art to utilize the pressure of the well fluid 68 in combination with a spring force of the bellows assembly 64 to positively pressurize the motor fluid 54. Initially, the motor fluid 54 is injected into the motor 14 and the bellows assembly 64 is pressurized until a desired positive pressure is obtained within the motor 14. For example, the system 10 may set an initial pressure, such as 25-100 psi, prior to submerging the system 10 into the well. The exterior chamber 70 adjacent the bellows assembly 64 also may be filled with fluid prior to submerging the system into the well. The well fluid 68 enters the housing 38 through ports 72 and mixes with this fluid in exterior chamber 70 as the system 10 is submersed into the well. Operation of the bellows assembly 64 illustrated by FIG. 2 is well known in the art and requires no further explanation to the skilled artisan. The bellows assembly 64 also may have various protection elements to extend its life and to ensure continuous protection of the motor 14. For example, a filter 74 may be disposed between the ports 72 and the exterior 70 of the bellows assembly 64 to filter out undesirable fluid elements and particulates in the well fluid 68 prior to fluid communication with the exterior 70. A filter 76 also may be provided adjacent the interior 66 of the bellow assembly 64 to filter out motor shavings and particulates. As illustrated, the filter 76 is positioned adjacent the moisture absorbent assembly 60 between the motor cavity 62 and the interior 66 of the bellows assembly 64. Accordingly, the filter 76 prevents solids from entering or otherwise interfering with the bellows assembly 64, thereby ensuring that the bellows assembly 64 is able to expand and contract along with volume variations in the fluids.

A plurality of expansion and contraction stops also may be disposed about the bellows assembly 64 to prevent over and under extension and to prolong the life of the bellows assembly 64. For example, a contraction stop 78 may be disposed within the interior 66 of the bellows assembly 64 to contact an end section 80 and limit contraction of the bellows assembly 64. An expansion stop 82 also may be provided at the exterior 70 of the bellows assembly 64 to contact the end section 80 and limit expansion of the bellows assembly. These contraction and expansion stops 78 and 82 can have various configurations depending on the material utilized for the bellows assembly 64 and also depending on the pressures of the motor fluid 54 and the well fluid 68. A housing 84 also may be disposed about the exterior 70 to guide the bellows assembly 64 during contraction and expansion and to provide overall protection about the exterior 70.

As the system 10 is submersed and activated in the downhole environment, the internal pressure of the motor fluid 54 may rise and/or fall due to temperature changes, such as those provided by the activation and deactivation of the motor 14. A valve 86 may be provided to release motor fluid 54 when the pressurization exceeds a maximum pressure threshold. In addition, another valve may be provided to input additional motor fluid when the pressurization falls below a minimum pressure threshold. Accordingly, the valves maintain the desired pressurization and undesirable fluid elements are repelled from the motor cavity 62 at the shaft seals 50 and 52. The system 10 also may have a wiring assembly 87 extending through the housing 38 to a component adjacent the bellows assembly 64. For example, a variety of monitoring components may be disposed below the bellows assembly 64 to improve the overall operation of the system 10. Exemplary monitoring components comprise temperature gauges, pressure gauges, and various other instruments, as should be appreciated by those skilled in the art.

Figure 3:
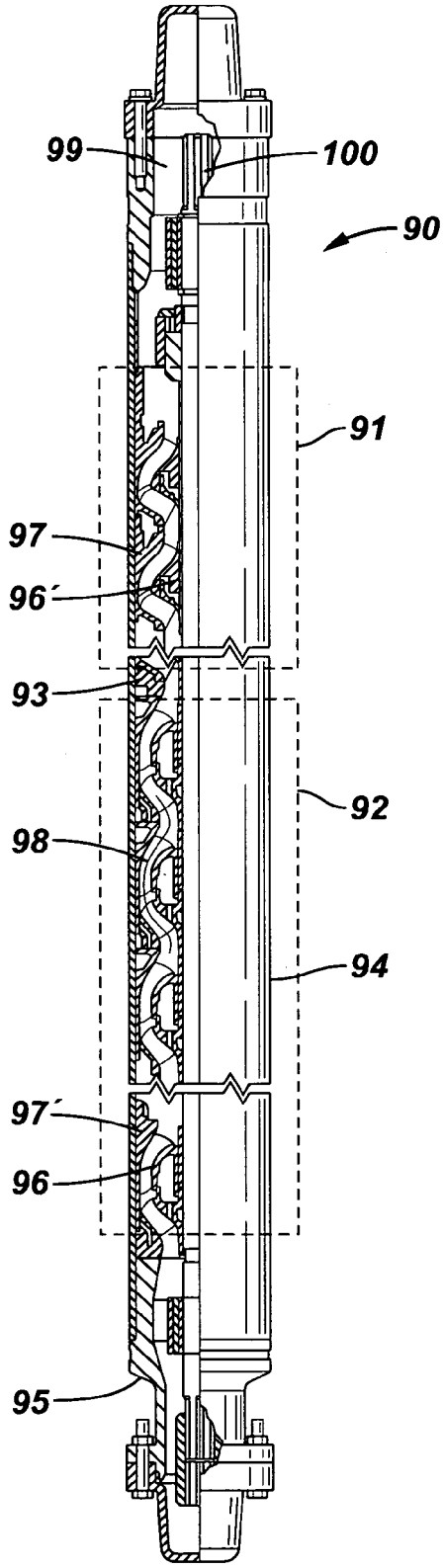
FIG. 3 is a schematic side elevation view, partially in cross-section, of one apparatus in accordance with the invention.
Figure 4A:
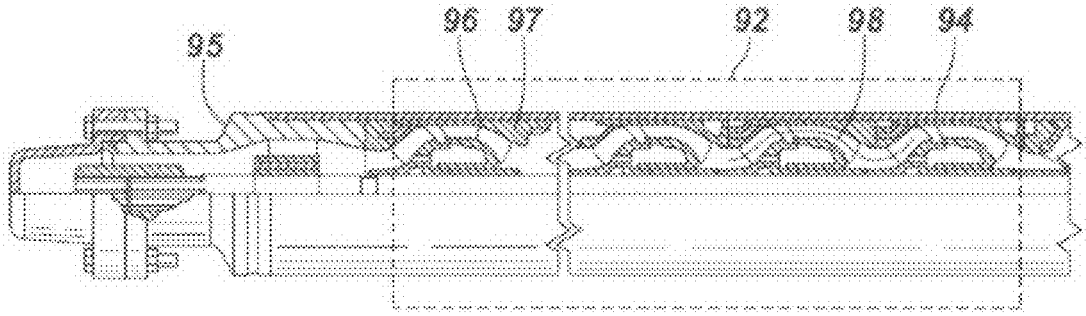
FIGS. 4A and 4B are slightly larger schematic side elevation views, partially in cross section, of the apparatus of FIG. 3.
Figure 4B:
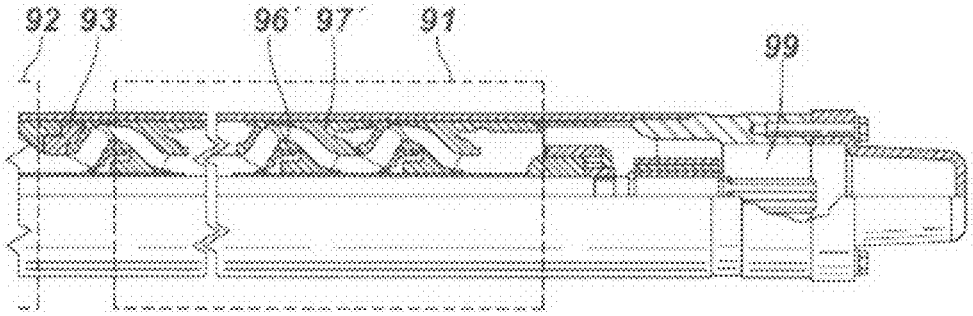

FIG. 3 is a schematic side elevation view, partially in cross-section, and not necessarily to scale, of one pump apparatus 90 in accordance with the invention. Apparatus 90 includes two different pump stages indicated by dashed line boxes 91 and 92 and connected through a connector 93. Also illustrated is a pump housing 94 which houses both pump stages 91 and 92. Pump intake 95 allows well or reservoir fluids to enter pump apparatus 90. A first set of impellers 96 and diffusers 97 move fluid through stage 92 as depicted by curved line 98 (upwards in FIG. 3, although the invention is not so limited) toward second stage 91, having a different set of impellers 96' and diffusers 97', eventually forcing fluid out through a discharge 99. Impellers 96 and 96' are all removably fastened to a pump shaft 100, which is powered by one or more motors (not illustrated). FIGS. 4A and 4B illustrate the same features as FIG. 3 but in a more expanded view, illustrating in more detail pump stages 91 and 92. In certain embodiments, the stage producing the higher flow rate may be positioned on the "bottom", in this case stage 92, although the invention is not so limited. Sealing rings (not illustrated) may be installed in stages directly below connector 93. Bearing housings may be placed at the first stage below the top or last diffuser in stage 92. The bearing housing location may increase one stage for each housing length required. The top-most diffuser (nearest the pump discharge) may have its male nest removed.

Figure 5:
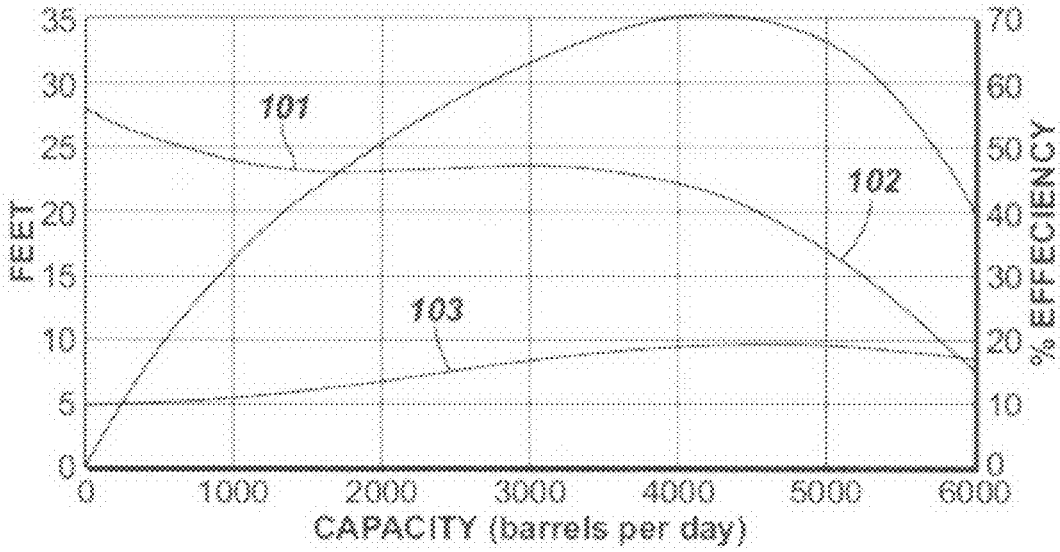
FIGS. 5 and 6 are performance characteristic charts for two different prior art electrical submersible pumps.
Figure 6:
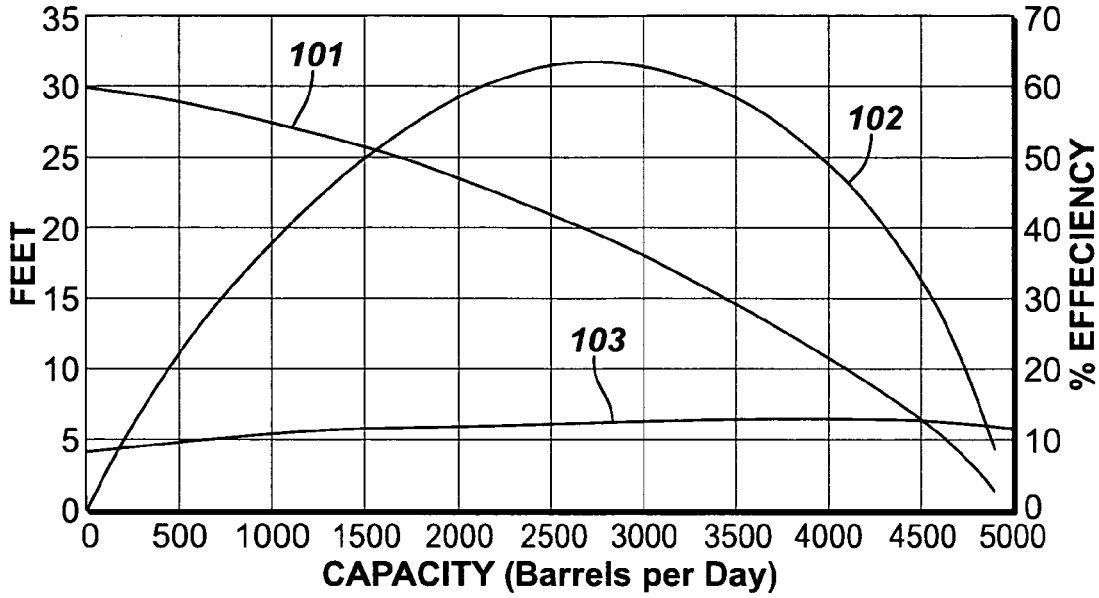
Figure 7:
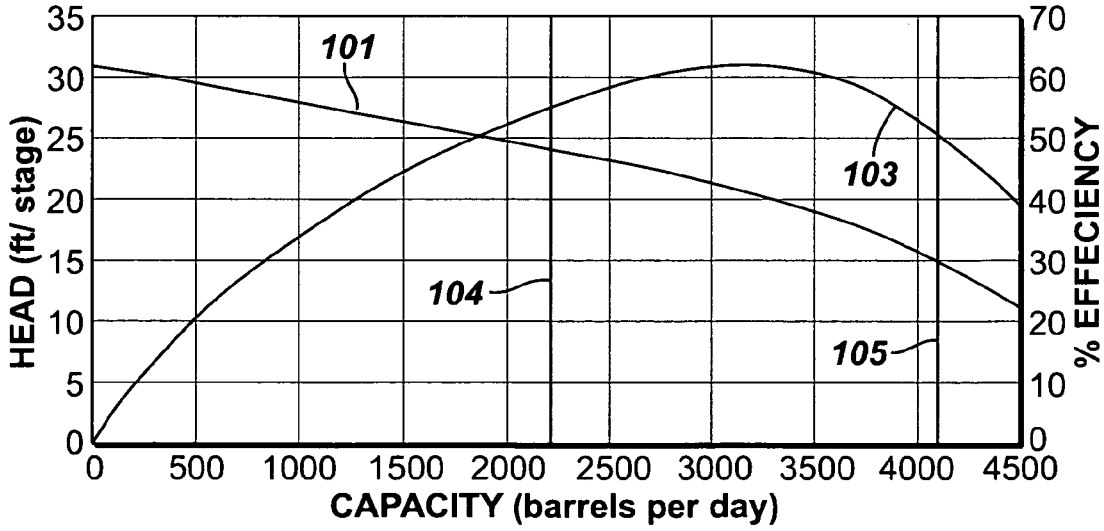
FIG. 7 is a performance characteristic chart for an electrical submersible pump of the invention constructed from the different pumps stages of FIGS. 5 and 6.

As an example of the invention, head flow characteristics and operating ranges of two pump stages individually and as combined in accordance with the invention are now discussed in reference to FIGS. 5, 6, and 7. A stage mixing percentage or stage mixing ratio of 1:1 may be used as an example. A stage mixing ratio of 1:1 means that in a pump having 100 total stages, one set of 50 stages are of a pump stage type having a first head flow characteristic and operating range, and a second set of 50 pump stages are comprised of a pump stage type having a second head flow characteristic different from the first set. In a similar way, other performance parameters like thrust, efficiency, and brake horsepower can be considered and different stage mixing ratios can be used. The different performance characteristics of two different pump stages, known under the trade designation D4300N and D3000N, available from Schlumberger Technology Corporation (Sugar Land, Tex.), are illustrated in FIGS. 5 and 6, respectively. The operating range for these pumps is given in Table 1. By combining the two stages, using 1:1 stage mixing ratio, head flow characteristics and operating range are changed to that indicated for the pump D3400N in Table 1 and FIG. 7.

The operating range of the pump known under the trade designation D4300N is from about 3500 to about 5400 barrels per day (BPD) at 60 Hertz (Hz) as illustrated in FIG. 5 by curve 102. Note that the head curve 101 is relatively flat below a flow rate of about 3500 BPD. Therefore, the useable operating range of this pump may not reach lower than about 3500 BPD due to very flat head flow characteristics, which may cause the pump operation in the field to be unstable and unreliable, as well as inefficient as depicted by curve 103. The operating range of the pump known under the trade designation D3000N is from about 2200 to about 3700 BPD at 60 Hz as illustrated in FIG. 6 by curve 102 and may not exceed more than about 3700 BPD due to lower efficiency (curve 103) and lower head (curve 101). However, if the two stages represented by the pump characteristics in FIGS. 5 and 6 are combined, in accordance with one embodiment of the invention, the operating range limitations of both pumps may be reduced or overcome. Performance characteristics of the new pump stage, D3400N at 60 Hz are illustrated in FIG. 7 by curves 101 (head), capacity (103) and useful capacity operating range (between vertical lines 104 and 105). In this way, limitations of the pump known under the trade designation D4300N of not being able to operate below about 3500 BPD flow and of the pump known under the trade designation D3000N of not being able to exceed more than 3700 BPD flow may be overcome. Pump performance characteristics for other electrical frequencies may be computed using methods known in the art.

TABLE 1

| Combining pump stages in 1:1 stage mixing ratio: | | | |
|---|---|---|---|
| | D4300N | D3000N | D3400N |
| Operating Range (BPD) @ 60 Hz | 3500-5400 | 2200-3700 | 2200-4100 |

Figure 8:
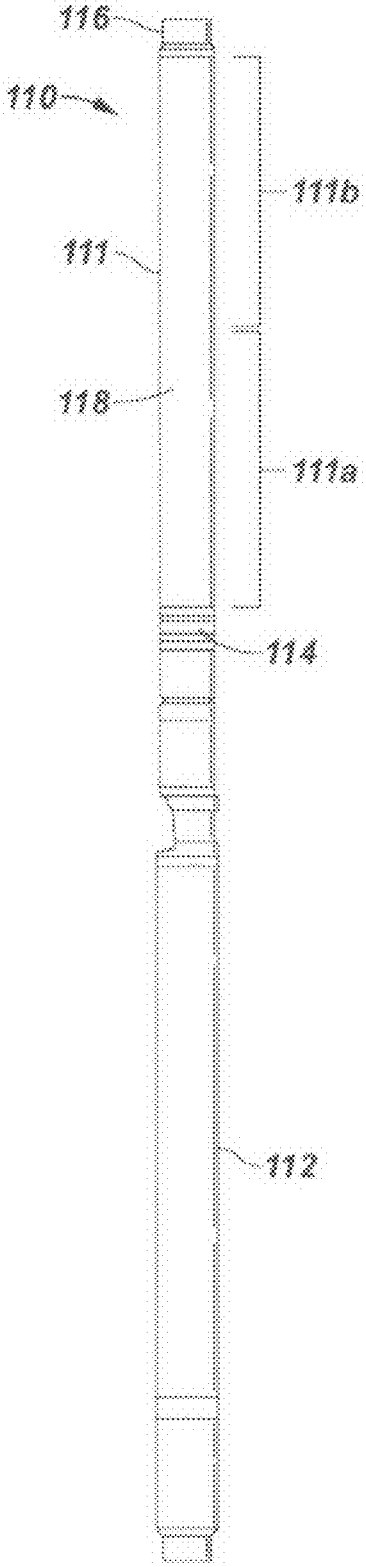
FIG. 8 is a schematic side elevation view of one alternative apparatus in accordance with the invention.

FIG. 8 illustrates another electrical submersible pump 110 of the invention, which is a modified version of a pumping system known under the trade designation Axia™, available from Schlumberger Technology Corporation. Pumps of this type may feature a simplified two-component pump-motor configuration, with pump illustrated generally at 111 having two stages 111*a* and 111*b* in accordance with the invention inside a housing 118, and a combined motor and protector at 112. Pump 110 may be built with integral intakes 114 and discharge heads 116. Fewer mechanical connections may contribute to faster installation and higher reliability of this embodiment. The combined motor and protector assembly 112, known under the trade designation ProMotor™, may be prefilled in a controlled environment, and may include integral instrumentation that measures downhole temperatures and pressures.

Figure 9:
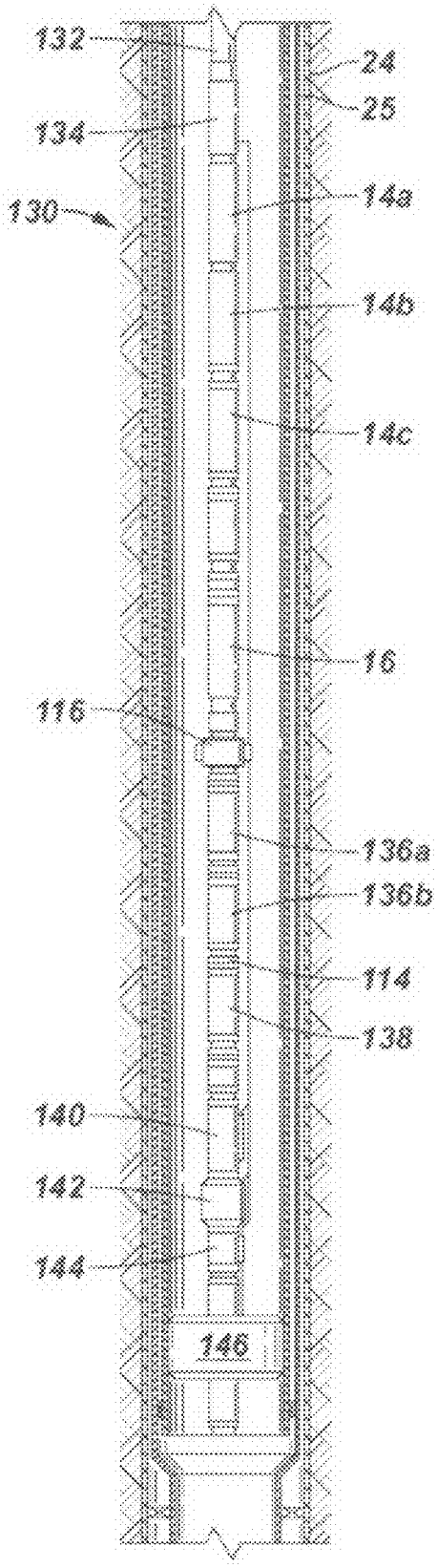
FIG. 9 is a schematic side elevation view, partially in cross section, of another alternative apparatus of the invention.

FIG. 9 illustrates another alternative electrical submersible pump configuration 130 in accordance with the invention. As discussed herein, ESPs are designed to certain specifications so problems may appear when the equipment is mis-applied or misoperated. There are limitations regarding pressure, temperature, motor horsepower, and the like, which may be interrelated. How close to the envelope the ESP is operated may ultimately effect system longevity. Very often the ESP cost is a fraction of the workover costs. In an effort to mitigate the life cycle costs, alternative methods of ESP deployment have been investigated. This has included, over the past 20 years, an ESP deployed on cable, an ESP deployed on coiled tubing with power cable strapped to the outside of the coiled tubing (the tubing acts as the producing medium), and more recently a system known under the trade designation REDACoil™ as illustrated in FIG. 9 with a power cable 132 deployed internally in coiled tubing 25. In the embodiment 130 illustrated in FIG. 9, three "on top" motors 14*a*, 14*b*, and 14*c* drive three pump stages 136*a*, 136*b*, and 138. Inlet 114 is shown for pump 136*b*, and pump discharge for all pumps is illustrated at 116. Pump stages 136*a* and 136*b* may be identical in number of pump stages and performance characteristics, while pump stage 138 has different performance characteristics, in accordance with the invention. A separate protector 16 is provided, as well as an optional pressure/temperature gauge 140. Also provided in this embodiment is a sub-surface safety valve (SSSV) 142 and a chemical injection mandrel 144. A lower connector 134 is employed, which may be hydraulically releasable with power cable 135, and may include a control line and instrument wire feedthrough. A control line set packer, 146, completes this embodiment. The technology of bottom intake ESPs (with motor on the top) has been established over a period of years. It is important to securely install pump stages, motors, and protector within coiled tubing 25, enabling quicker installation and retrieval times plus cable protection and the opportunity to strip in and out of a live well. This may be accomplished using a deployment cable 132, which may be a cable known under the trade designation REDACoil™, including a power cable and flat pack with instrument wire and one or more, typically three hydraulic control lines, one each for operating the lower connector release, SSSV, and packer setting/chemical injection.

Figure 10:
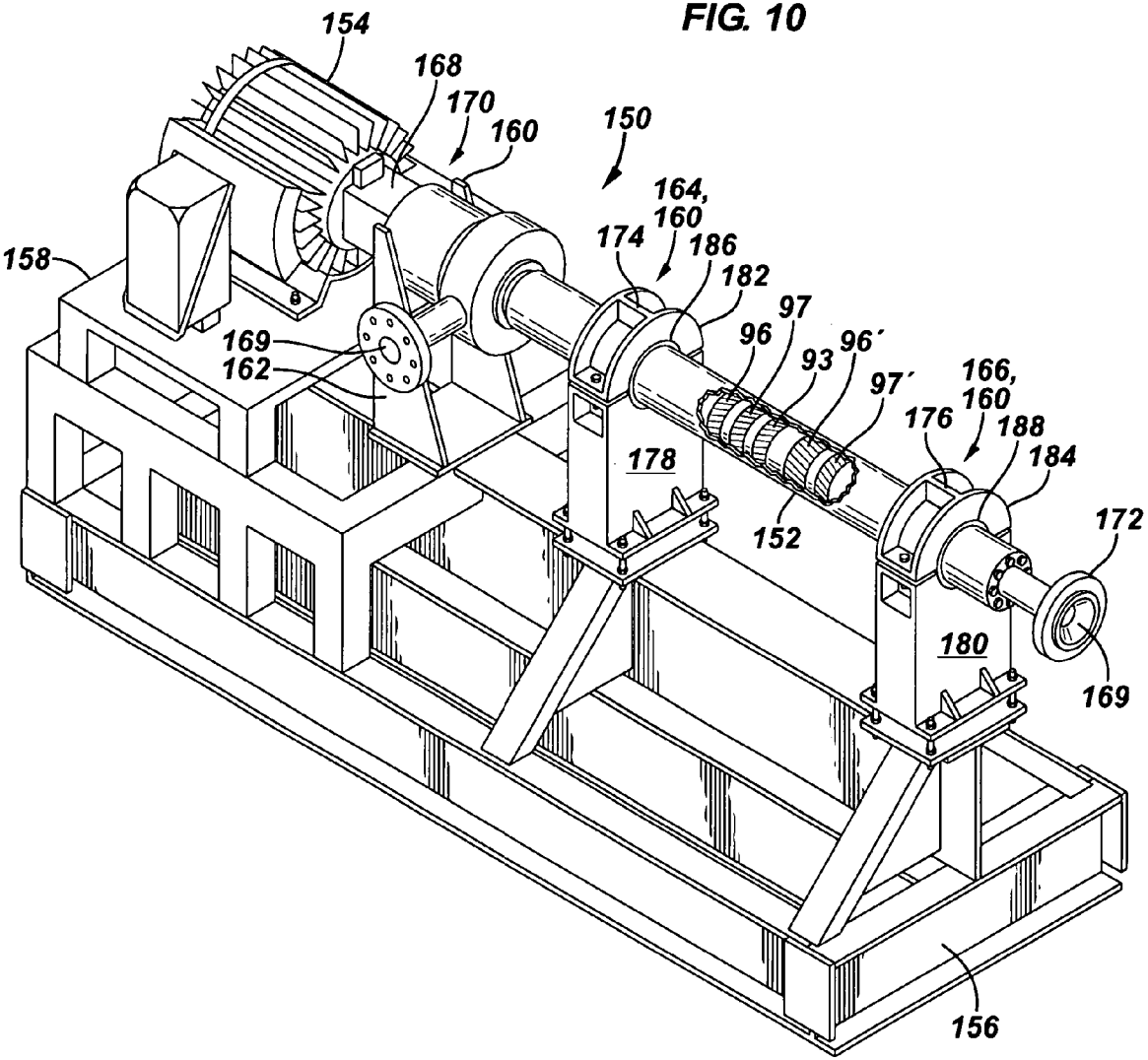
FIG. 10 is a schematic side elevation view, partially in cross section, of yet another apparatus of the invention.

In a variety of applications, it is advantageous to utilize a surface pump, such as a horizontal pumping system ("HPS"). Referring generally to FIG. 10, an exemplary horizontal pumping system ("HPS") 150 is illustrated according to the present invention in perspective, with parts broken away. The HPS 150 includes a pump 152, a motor 154 drivingly coupled to pump 152, and a horizontal skid 156 for supporting pump 152 and motor 154. As with submersible pumps of the invention, the principles of the invention are pertinent only when pump 152 comprises a centrifugal pump, while motor 154 may be substituted for any of a number of drivers, such as turbines, generators, and the like. However, the HPS may comprise other pumps, such as positive displacement pumps, in conjunction with the centrifugal pump, and other drivers for a given application. Pump 152 includes a first set of impellers 96 and diffusers 97 designed move fluid through pump 152 toward second stage having a different set of impellers 96' and diffusers 97', eventually forcing fluid out through a discharge 169, wherein the other pump conduit 169 is a pump intake. Apparatus 150 includes two different pump stages connected through a connector 93. As may be seen a single pump housing houses both pump stages.

As explained in assignee's U.S. Pat. No. 6,425,735, motor 154 may be fixedly coupled to horizontal skid 156 at a motor mount surface 158 of horizontal skid 156. Pump 152 may be coupled to horizontal skid 156 by a mount assembly 160. Mount assembly 160 may include a support 162 (e.g., a fixed support) and clamp assemblies 164 and 166. Support 162 extends outwardly from the motor mount surface 158 at an axial position 168 lengthwise along horizontal skid 156. Pump 152 is drivingly coupled to motor 154 through support 162.

Alternatively, support 162 may be an external conduit assembly configured for attachment to a pump conduit, such as one of two pump conduits 169 extending from pump 152. Support 162, in either the illustrated configuration or as an external conduit assembly, may axially fix pump 152 or may allow axial movement of pump 152 with respect to support 162. Pump conduits 169 are configured to receive and expel a fluid, or vice versa, as pump 152 operates. For example, pump 152 may displace water, salt water, sewage, chemicals, oil, liquid propane, or other fluids in through one of the pump conduits 169 and out of the other pump conduit 169. In addition, the temperature of the fluids may vary. For example, some applications may involve pumping hot fluids, while others may involve pumping cold fluids. In addition, the temperature may change during the pumping operation, either from the source of the fluid itself, or possibly due to the heat generated by the operation of pump 152 and/or motor 154. In addition, temperature may change dramatically due to weather change.

Pump 152 may have a fixed end 170 and a free end 172, fixed end 170 being axially fixed at support 162. Clamp assemblies 164 and 166 may be coupled to horizontal skid at axial positions 174 and 176, respectively, and preferably generally parallel with support 162. Clamp assemblies 164 and 166 have base members 178 and 180 and upper clamps 182 and 184, creating clamping conduits 186 and 188, respectively, for mounting pump 152 in clamping conduits 186 and 188.

Clamp assemblies 164 and 166 may be configured to allow axial movement of pump 152 through clamping conduits 186 and 188. This axial freedom is intended to reduce stresses and fatigue, and possible mechanical failure, due to vibrations and thermal expansion/contraction of pump 152. Furthermore, the number and geometry of clamp assemblies may vary depending on the application, size of pump 152, and other factors.

Apparatus of the invention may include many optional items. One optional feature of apparatus of the invention is one or more sensors located at the protector 16 to detect the presence of hydrocarbons (or other chemicals of interest) in the internal lubricant fluid 54. The chemical indicator may communicate its signal to the surface over a fiber optic line, wire line, wireless transmission, and the like. When a certain chemical is detected that would present a safety hazard or possibly damage motor 14 if allowed to reach the motor, the pump may be shut down long before the chemical creates a problem.

A typical use of apparatus of this invention will be in situations when available pumps on-site are not adequate to meet a required pumping requirement. Production of fluid using coiled tubing or other tubing may become more difficult as a well's pressure changes at a constant depth, or if the well is drilled deeper than originally planned. In these situations, forcing available pumps to do the pumping job may not only be inefficient, but may be unsafe. Apparatus of the invention may then be employed to solve the problem, particularly if the technicians have the equipment, tools, and know-how to connect two or more different pump stages having different performance characteristics.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, no clauses are intended to be in the means-plus-function format allowed by 35 U.S.C. § 112, paragraph 6 unless "means for" is explicitly recited together with an associated function. "Means for" clauses are intended to cover the structures described herein as performing the recited function and not only structural equivalents, but also equivalent structures.

What is claimed is:

1. An apparatus comprising:

(a) a driver;

(b) a driver shaft turned by the driver; and (c) at least two centrifugal pump stages on a pump shaft arranged in series and having different performance characteristics, the pump shaft coupled to the driver shaft by one or more items selected from a coupling, a protector, a seal chamber, a thrust chamber, and combinations thereof.

2. The apparatus of claim 1 wherein the at least two centrifugal pump stages comprise a first set of centrifugal pump stages each having a first defined set of performance characteristics, and a second set of centrifugal pump stages each having a second defined set of performance characteristics.

3. The apparatus of claim 1 wherein the at least two centrifugal pump stages comprise a first set of centrifugal pump stages and a second set of centrifugal pump stages, wherein each centrifugal pump stage in the first set has first identical performance characteristics, and each centrifugal pump stage in the second set of pump stage has second identical performance characteristics.

4. The apparatus of claim 1 wherein the performance characteristics are selected from head flow characteristics, brake horsepower characteristics, operating range, thrust characteristics, efficiency, net positive suction head, and two or more thereof.

5. The apparatus of claim 1 having a stage mixing ratio ranging from about 1:99 to about 99:1.

6. The apparatus of claim 5 wherein the stage mixing ratio ranges from about 1:9 to about 9:1.

7. The apparatus of claim 6 wherein the stage mixing ratio ranges from about 3:7 to about 7:3.

8. The apparatus of claim 7 wherein the stage mixing ratio is 1:1.

9. The apparatus of claim 1 wherein the driver is a motor and the coupling is a protector separate from the motor.

10. The apparatus of claim 1 wherein the driver is a motor and the coupling is a protector integral with the motor.

11. The apparatus of claim 1 including integral instrumentation adapted to measure one or more downhole parameters.

12. The apparatus of claim 1 in the form of an electric submersible pump.

13. The apparatus of claim 1 in the form of a horizontal pumping system.

14. A method comprising:

(a) selecting a first centrifugal pump stage comprising a first set of centrifugal pump stages, the first set of centrifugal pump stages each having a first pump performance characteristic;

(b) selecting a second centrifugal pump stage comprising a second set of centrifugal pump stages, the second set of centrifugal pump stages each having a second pump performance characteristic;

(c) attaching the first and second sets of centrifugal pump stages in series on a common pump shaft; and (d) coupling a driver to the pump shaft by one or more items selected from a coupling, a protector, a seal chamber, a thrust chamber, and combinations thereof.

15. The method of claim 14 wherein the performance characteristics are selected from head flow characteristics, brake horsepower characteristics, operating range, thrust characteristics, efficiency, net positive suction head, and two or more thereof.

16. The method of claim 14 wherein the selecting steps comprise having a stage mixing ratio ranging from about 1:99 to about 99:1.

17. A method comprising:

(a) determining a pumping requirement for transferring a fluid;

(b) selecting at least two centrifugal pump stages to operate in series to form a pump, the pump having a pump shaft, the at least two centrifugal pump stages of the pump having different performance characteristics;

(c) coupling a driver to the pump shaft by one or more items selected from a coupling, a protector, a seal chamber, a thrust chamber, and combinations thereof; and (d) pumping the fluid using the pump to meet the pumping requirement.

18. The method of claim 17 wherein the selecting at least two centrifugal pump stages comprises selecting a first set of centrifugal pump stages each having a first defined set of performance characteristics, and selecting a second set of centrifugal pump stages each having a second defined set of performance characteristics, and wherein the second stage performance characteristics compensate for one or more deficiencies in performance of the first stage.

19. The method of claim 17 wherein the selecting at least two centrifugal pump stages comprises selecting a first set of centrifugal pump stages, each stage having a first identical set of performance characteristics, and selecting a second set of centrifugal pump stages, each stage having a second identical set of performance characteristics, and wherein the second stage performance characteristics compensate for one or more deficiencies in performance of the first stage.

20. The method of claim 17 comprising pumping the fluid using the first pump stage at a first head to the second stage, and pumping the fluid using the second pump stage at a second head.

21. The method of claim 17 wherein the first stage operates at a first efficiency, power, down thrust, and net positive suction head, and the second pump stage operates at a second efficiency, power, down thrust, and net positive suction head.

* * * * *